United States Patent [19]

Aeschbacher et al.

[11] 4,089,465

[45] May 16, 1978

[54] WEAR PROTECTIVE LINER ASSEMBLY

[75] Inventors: Hans Manuel Aeschbacher, Schaffhausen; Johann Bottlang, Eschenz, both of Switzerland

[73] Assignee: Georg Fischer Aktiengesellschaft, Schaffhausen, Switzerland

[21] Appl. No.: 750,672

[22] Filed: Dec. 15, 1976

[30] Foreign Application Priority Data

| | | |
|---|---|---|
| Dec. 23, 1975 | Switzerland | 16666/75 |
| Sep. 3, 1976 | Switzerland | 11195/76 |

[51] Int. Cl.[2] ..... B65D 25/14; B65D 7/34

[52] U.S. Cl. ..... 220/400; 52/592; 220/76

[58] Field of Search ..... 220/63 R, 75, 76; 110/1 A; 52/535, 592

[56] References Cited

U.S. PATENT DOCUMENTS

| | | | |
|---|---|---|---|
| 485,810 | 11/1892 | Curtis et al. | 220/63 R |
| 1,386,554 | 8/1921 | Dalglish | 52/592 |
| 1,993,500 | 3/1935 | Benner | 220/63 R X |
| 3,204,380 | 9/1965 | Smith et al. | 52/592 X |
| 3,290,848 | 12/1966 | Moss | 52/592 X |
| 3,867,239 | 2/1975 | Alesi et al. | 52/592 X |

*Primary Examiner*—George E. Lowrance
*Assistant Examiner*—Steven M. Pollard
*Attorney, Agent, or Firm*—Toren, McGeady and Stanger

[57] ABSTRACT

A protective liner assembly is provided for the walls of a chamber subjected to wear, particularly a blast chamber, with the assembly being formed of a plurality of individual liner units arranged adjacent each other in a two-dimensional array, each of the liner units being formed of a quadrilateral plate member having a pair of raised flanges extending along two of its edges on one side thereof with another pair of raised flange members extending along the other two edges of the plate member on the opposite side thereof. When the liner units are placed adjacent each other in a two-dimension array to form the protective liner assembly, the flanges of a plate member will overlap the flanges of adjacent plate members thereby to provide a shielding effect for a chamber wall upon which the liner units are mounted by screws extending through the individual plate members.

16 Claims, 7 Drawing Figures

Fig. 4
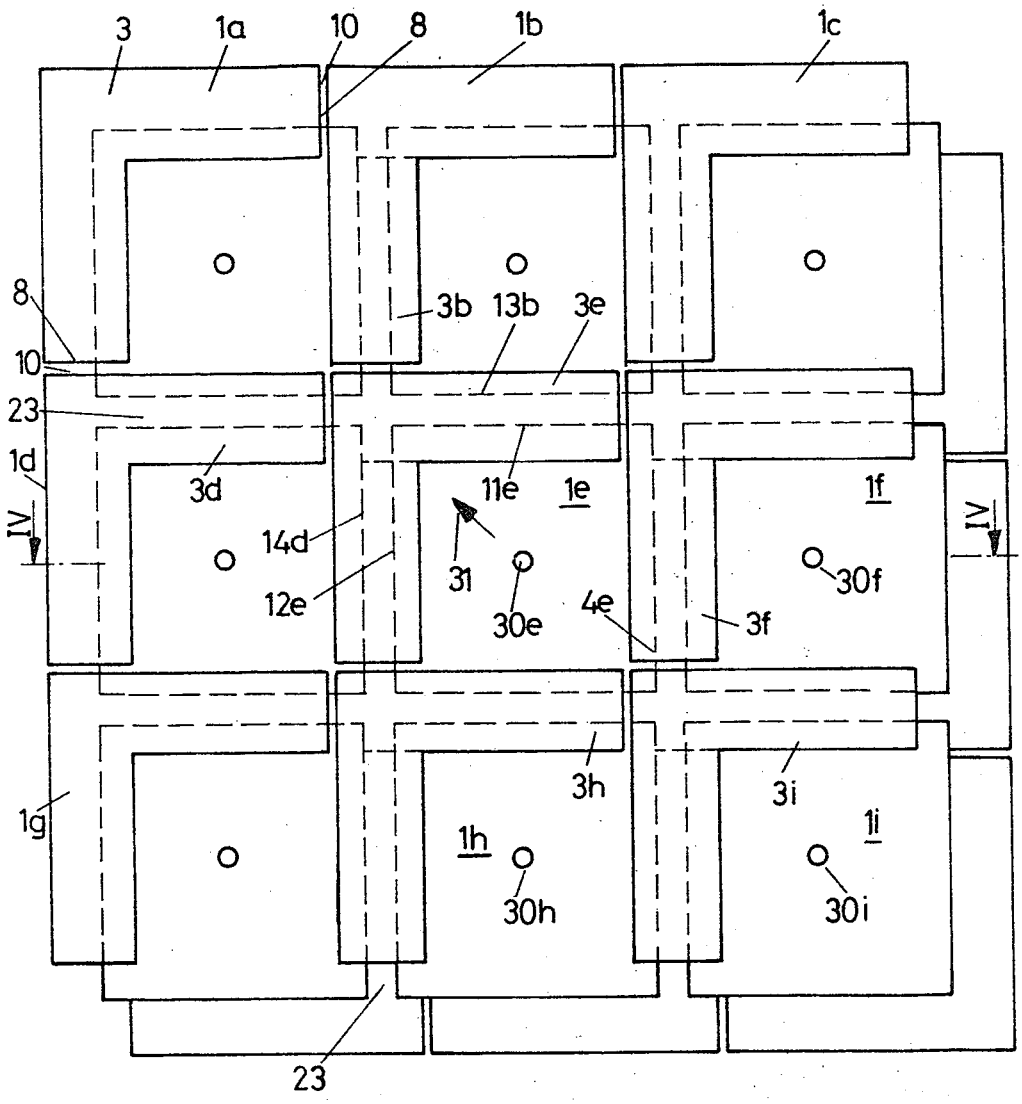
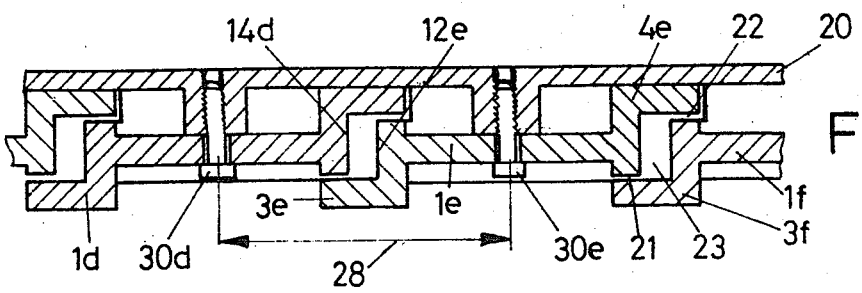
Fig. 5

WEAR PROTECTIVE LINER ASSEMBLY

BACKGROUND OF THE INVENTION

The present invention relates generally to wear protective liners for the inner walls of chambers which are subjected to excessive wear forces and the invention is more particularly directed to a liner assembly for a blast chamber.

It has been known in the prior art to line the walls of blast chambers, for example centrifugal blast chambers, with a series of individual plates in order to protectively cover the blast chamber wall. These plates, which for the most part have a square shape, generally include an edge which is offset to about half the plate thickness and which forms with an adjacent plate a labyrinth packing consisting of inlet and outlet gaps extending perpendicularly to the plate, and of an interposed horizontal gap. A disadvantage of this type of protective lining involves the fact that this type of packing requires high accuracy with regard to the dimensions of the plates. In addition, most blasting media particles which impinge upon the plate can, with prior art arrangements, penetrate directly into the gap between the plates and it has been found that the kinetic energy of the particles within the gap is not reduced sufficiently such that the particles may be prevented from issuing through the second vertical gap on the other side of the plates. The blasting media particles impinging substantially vertically upon the chamber walls may therefore cause considerable damage to the walls and excessive wear. At the junction of four identically designed wear protective plates there is formed a direct uncovered blasting media passage so that the chamber walls will be subjected to excessive wear at these points as well.

A further effect which occurs is that upon the flat unreinforced blast protective plates there will occur sagging under the stress produced by the centrifugal jet thereby resulting in a harmful increase in the gap of the labyrinth packing.

One prior art arrangement known from U.S. Pat. No. 2,478,153 involves an arrangement wherein the wear protective plates are arranged in an overlapping fashion. However, in this type of arrangement no overlapping is provided between adjacent plates on two sides of the plate. As a result, the chamber wall is not protected against wear at these points or gaps. In addition, elaborate fastening means are required for the plates in this type of arrangement.

The present invention is directed toward the provision of a wear protective liner assembly composed of reinforced wear protective plates which form a labyrinth packing with each adjacent plate upon all the peripheral sides and corners of each plate, with the packing effect being to a great extent independent of the manufacturing or dimensional tolerances of the plates and of slight positional changes in the plates. Furthermore, the invention is directed toward an assembly which provides at the same time improved protection against wear of the chamber wall over presently known embodiments. The assembly of the present invention is such that it will permit easy removal and replacement of individual plates upon the chamber walls where they are mounted.

SUMMARY OF THE INVENTION

Briefly, the present invention may be defined as a wear protective liner assembly formed from a plurality of individual liner units which are arranged adjacent each other in a two-dimensional array, with each of the liner units comprising a generally quadrilateral plate member having a first pair of raised lateral flanges extending along two edges of said plate member on one side thereof and a second pair of raised lateral flanges extending along the other two edges of said quadrilateral plate member on the opposite side thereof. When the individual liner units of the assembly are placed side by side in a two-dimensional array, each of the flange members of a given unit will be arranged to overlap a flange member of a next adjacent liner unit on all four sides of the plate member. Between overlapping flange members, there will be formed a labyrinth path through which any blasting media must pass in order to penetrate through the liner and impinge the walls of the chamber upon which the liner is mounted. Thus, a protective covering is formed and any blasting media which penetrates the labyrinth packing will have its energy virtually completely dissipated before impinging the wall of the chamber.

Each of the liner units of the invention is mounted to the wall of a chamber to be protectively covered by screws which may extend through a central opening in the plate member of the liner unit. Individual liner units may be removed and replaced by removing the screws from three adjacent liner units and appropriately displacing the liner units so that the one liner unit to be replaced may be removed.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 4 is a plan view showing a wear protective liner assembly in accordance with the present invention wherein nine contiguous wear protective units are arranged in a two-dimensional array;

FIG. 5 is a cross sectional view taken along a line IV—IV of FIG. 4;

DETAILED DESCRIPTION OF THE PREFERRED EMBODIMENTS

Figure 1:
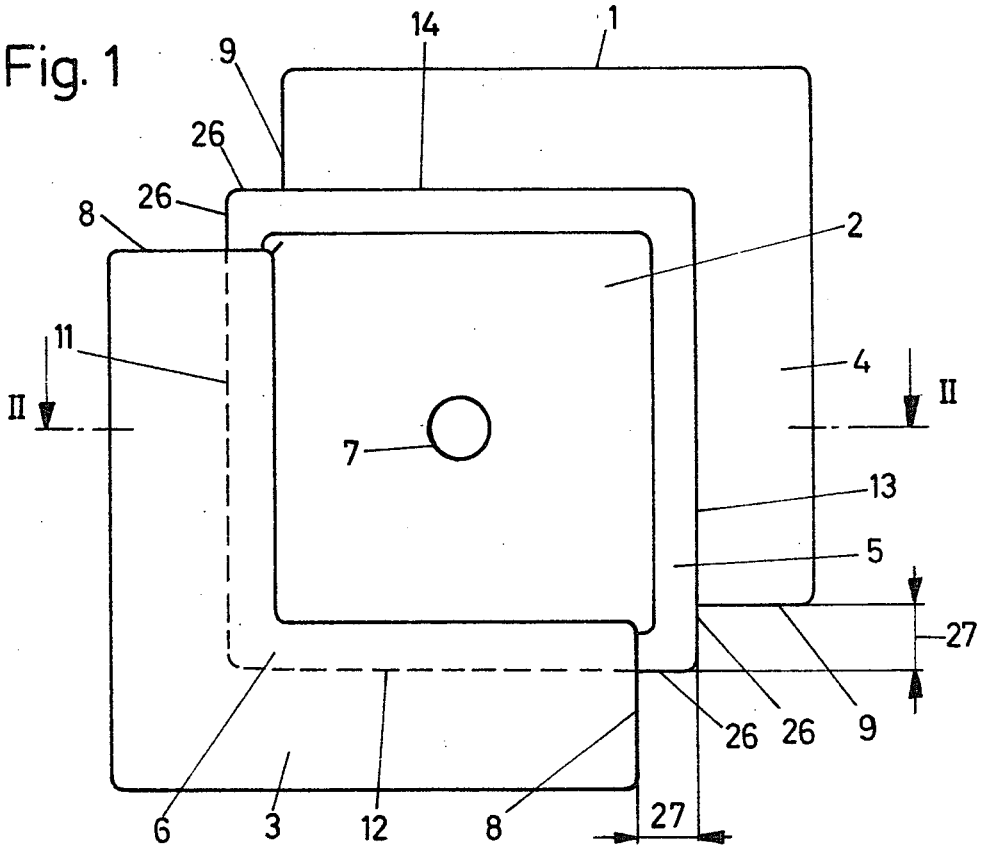
FIG. 1 is a plan view showing a wear protective unit in accordance with the present invention.
Figure 2:
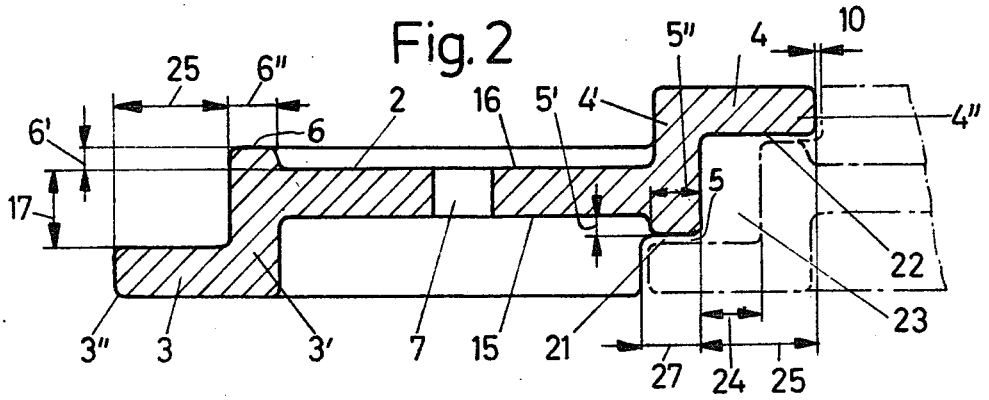
FIG. 2 is a cross sectional view taken through the wear protective unit of FIG. 1 along the line of II—II.

Referring now to the drawings wherein like reference numerals are used to identify similar parts throughout the various figures thereof, a wear protective liner unit 1 in accordance with the present invention is shown in FIGS. 1 and 2, with the unit 1 basically consisting of a plate member 2 having a generally planer square configuration with a first flange member 3 being formed on one side of the plate member 2 and a second flange member 4 being formed on the opposite side of the plate member 2. As will be apparent from FIGS. 1 and 2, each of the flange members 3 and 4 essentially comprise a pair of flanges each extending along one edge of the square or quadrilateral plate member 2, with each flange of the flange members 3 and 4 being raised from one of the surfaces of the plate member 2 and extending laterally outwardly therefrom. Accordingly, it will be seen that the flange member 3 essentially comprises a first pair of raised lateral flange extending along two edges of the plate member 2 on one side thereof and that the flange member 4 essentially comprises a second pair of raised lateral flanges extending along the other two edges of the plate member 2 on the opposite side thereof.

The plate member 2 comprises a pair of generally flat planer congruent sides or surfaces 15 and 16 with a centrally arranged hole 7 being provided to extend through the plate member 2 in order to enable the wear protective unit 1 to be mounted upon a chamber wall by means of a screw which will extend through the hole 7.

The flange member 3 is arranged to extend along two adjacent peripheral sides or edges 11 and 12 of the plate member 2 and it will be seen that the flange member 3 is raised or offset from the plate member in the direction of the plate surface 15. The flange member 4 is arranged on the opposite surface 16 of the plate member 2 and its flanges extend along two adjacent peripheral sides or edges 13 and 14 of the plate member 2, with flange member 4 being offset or raised from the plate member 2 in the direction of the opposite plate surface 16.

The flange members 3 and 4 are each formed, respectively, with a section 3', 4', which extends perpendicularly from the plate member 2 and with respective sections 3", 4", which extend parallel to the plate member 2. The thickness of the sections 3", 4" is generally equal to or slightly less than the thickness of the plate member 2. As will be seen best from FIG. 2, the unit 1 also includes a bead 5 and a bead 6 which essentially comprise raised portions extending along the edges of the plate member 2 on the sides thereof opposite the sides upon which the flanges 3 and 4 are formed. The beads 5 and 6 serve to reinforce the plate and the bead 5 is arranged on the surface 15 of the plate 2 and essentially comprises an extension of the section 4' of the flange member 4 while the bead 6 is formed on the surface 16 of the plate member 2 and essentially comprises an extension of the section 3' of the flange member 3. Referring to FIG. 1, it will be seen that the flange member 5 extends about the peripheral edges of the plate member 2 from one end 8 of the flange member 3 to the opposite end 8 thereof. Similarly, the bead 6 will extend on the opposite surface 16 of the plate member 2 along edges thereof from one end 9 of the flange member 4 to the opposite end 9 of the same flange member. In the embodiment represented in the drawings, the beads 5, 6 have a generally rectangular cross-sectional configuration with a height dimension 5', 6' which is less than the width 5",6" thereof, said width dimension extending parallel to the plate surfaces 15, 16. The degree of offset or stagger 17 of the flange portions 3", 4" related to the plate surface 15, 16 is, in the embodiment shown in FIG. 2, at least as great as the thickness of the plate 2 plus the height 5', 6' of the beads 5, 6.

In order to facilitate the assembly of the wear protective units 1 into a two-dimensional array, the flange members 3 and 4 are formed so that they extend between their respective ends, 8, 9 along the peripheral sides 11, 12, 13, 14 only for a distance far enough that they form with the flange members 3, 4 of respective adjacent wear protective units 1, a gap 10, with the smallest possible gap width depending upon the manufacturing precision of protective units 1. In this manner, zones 26 having a length dimension 27 are formed upon the peripheral sides 11, 12, 13, 14 where there is not provided a portion of the flange members 3, 4.

Figure 3:
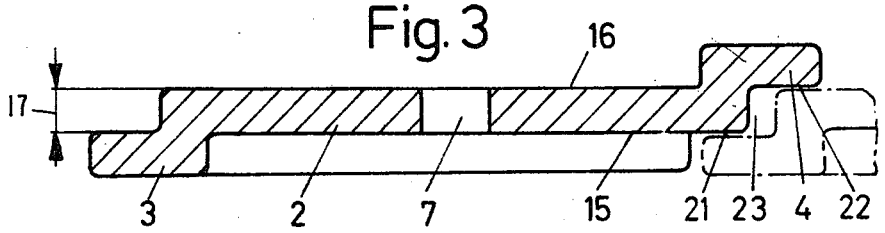
FIG. 3 is a cross sectional view of a second embodiment of a wear protective unit according to the present invention.

In FIG. 3 there is shown a simplified embodiment of the wear protective unit wherein the reinforcing beads 5, 6 are eliminated and where the stagger or offset 18 of the flange members 3 and 4 relative to the plate member 2 is equal to the thickness of the plate member 2 or generally corresponding thereto.

In FIGS. 2, 3 and 5 there is shown the labyrinth packing formed by joining the wear protective units 1 together in a two-dimensional array, with said packing consisting of an inlet and outlet gap 21 and 22 extending parallel to the plate surfaces 15 and 16 and a calming chamber 23.

Only a small amount of the blasting media impinging upon the wear protective units 1 mostly in a vertical direction will be able to penetrate into the inlet gap 21 extending parallel to the plates. In the calming chamber 23, the blasting media will lose its energy by repeated deflections and the probability that it will leave the calming chamber 23 through the outlet 22 is about as great as the probability that the blasting media will return and be deflected back into the blast chamber through the inlet gap 21. Both the amount and the energy of the blasting media particles impinging upon a chamber wall 20 upon which the wear protective liner assembly of the present invention is applied are thus reduced in the calming chamber 23. The blasting media issuing between the wear protective unit 1 and the chamber wall 20 through the outlet gap 22 extending parallel thereto impinges upon the chamber wall 20 with a flat impact angle, great scatter and low energy thereby resulting in much less wear of the chamber wall 20 than was the case with previously utilized models. In addition, better protection is achieved compared to known protective devices since there is no room for the direct passage of the blasting media at the junctions of the four wear protective plates.

The embodiment shown in FIG. 2 has the advantage, in addition to the reinforced plate, that the blasting media particles moving along the plate surface 16 are prevented by the bead 6 from penetrating into the inlet gap 21 and are deflected again in the direction of the blast chamber.

As will be seen from FIG. 4, continuous vertical and horizontal chambers are formed from the calming chambers 23 by assembling several wear protective units 1 through which a large part of the blasting media penetrating into the vertical chambers runs off at the bottom.

The width 24 of a calming chamber 23 (see FIG. 2) results from the width 25 of the flange members 3, 4 plus the width of gap 10 minus the length 27 of the zones 26 of the peripheral sides 11, 12, 13, 14. In this way, the width 24 of the calming chambers 23, and thus also the distance 28 of the fastening points on the chamber wall 20, are determined by the mass of the wear protective units and may not be selected at random if a small gap 10 and thus a good wear protective action is to be achieved.

For easy assembling and disassembly of the wear protective units, it is necessary that the width 24 of the calming chamber 23 be equal or greater than one-half the width 25 of the flange member 3, 4. This means that the wear protective unit must be so designed that the width 25 of the raised flange members 3, 4 must be double the length of the zone 26 of the peripheral sides 11, 12, 13, 14 which are not provided with the flange members 3, 4.

This type of design, which may also be utilized to advantage in an embodiment such as that represented in FIG. 3, permits easy replacement of the individual wear protective units, as will be described hereinafter with reference to FIGS. 4 and 5.

FIG. 4 shows a two-dimensional array of wear protective units 1*a*–1*i*, with each of the wear protective units being arranged side by side with their flange members 3, 4 overlapping in the manner indicated. Each of the wear protective units 1*a*–1*i* is attached to a chamber wall 20 by means of a screw member 30, there being provided screw members for each of the protective units 1*a*–1*i*, with screw members 30*d*, 30*e*, 30*f*, 30*h* and 30*i* being shown.

If the central wear protective unit 1*e* is to be removed and replaced, it is then necessary to remove its fastening screw 30*e* as well as the fastening screws 30*f*, 30*h* and 30 *i* of the three adjacent wear protective units 1*f*, 1*h* and 1*i*. These screws must be loosened a sufficient amount such that the wear protective units may be lifted away from the wall 20 a distance at least equivalent to its plate thickness. The wear protective unit 1*a* is then lifted so far that its flange member 3*e* may be pushed over the flange member 3*b* and 3*d* of the wear protective units 1*b* and 1*d* in the direction of arrow 31.

The adjacent wear protective units 1*f*, 1*h* and 1*i* are also lifted by flange 4*e*, which is only possible if the fastening screw is loosened. The lifted wear protective unit 1*e* is displaced in the direction of arrow 31 far enough until the peripheral sides 11*e* and 12*e* touch the peripheral sides 13*b* and 14*b* of the adjacent wear protective unit 1*b* and 1*d* in order to lift them subsequently far enough until their flanges 4*e* bear upon the flanges 3*f* and 3*h* of the adjacent wear protective units 1*f* and 1*h*. However, this is only possible if, as described above, the width 24 of the calming chamber is equal to or greater than one-half the width of the flanges 3, 4. Subsequently, the wear protective unit is again placed in the direction of the arrow until it may be completely removed. The insertion of a new wear protective unit may be effected in reverse order.

Figure 6:
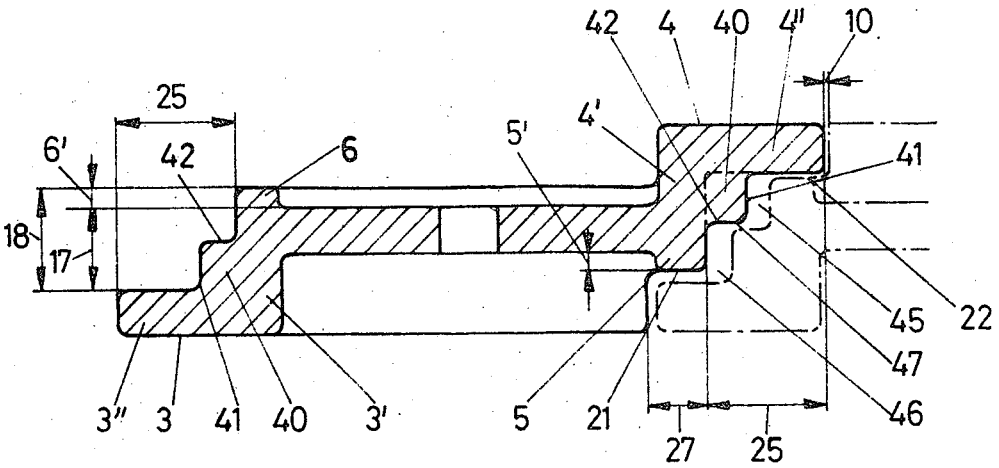
FIG. 6 is a sectional view showing a third embodiment of a wear protective unit in accordance with the invention.
Figure 7:
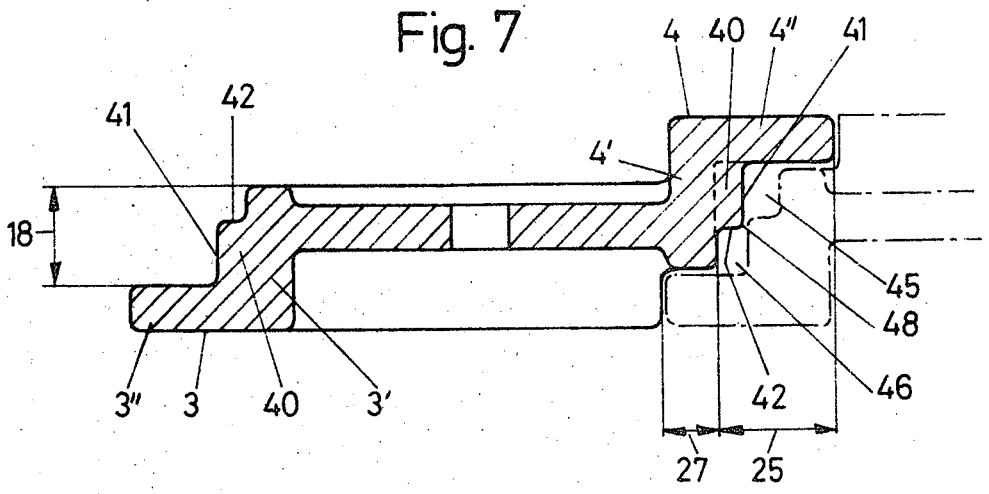
FIG. 7 is a sectional view of a fourth embodiment of a wear protective unit according to the invention.

FIGS. 6 and 7 show in cross-section additional embodiments of a wear protective unit in accordance with the present invention wherein a projection or ledge 40 is arranged in the fillets formed in the flange members of the unit, with the ledge 40 extending along the respective edge zones 3' and 3'', 4' and 4''. The ledge 40 is formed with a substantially rectangular cross-sectional configuration having one side 41 which extends parallel to the perpendicular flange sections 3', 4', respectively with the other side 42 thereof extending parallel to the parallel flange zones 3' and 4', respectively, so that a step offset is obtained.

In the embodiment according to FIG. 6, one side 41 of the ledge or projection 40 is at most half the size of the entire width 18 of the flange sections 3', 4' and the other side 42 is at least half the size, but smaller than the difference between the width 25 of the flange section 3, 4 and the above-mentioned length 27.

Due to the stepped offset, a pair of chambers 45 and 46 are formed when a pair of wear protective units are placed together, with the chambers being connected with each other by a horizontal gap 47. Thereby, the packing effect of the inlet gap 21 and the outlet gap 22 is increased.

In the embodiment according to FIG. 7, one side 41 of the projection or ledge 40 is slightly larger than the half width 18 of the flange section 3', 4', respectively, and the other side 42 is at most half as large as the difference between the width 25 and the length 27. In this manner, the two chambers 45 and 46 are likewise formed when a pair of wear protective units are placed together, but these are connected with each other by a vertical gap 48 which likewise increases the packing effect. The replacement of a wear protective unit according to FIGS. 6 or 7 may be effected exactly as described above with reference to FIGS. 3 and 4 and the condition that the width 25 of the raised lateral flange members 3, 4 must be equal to or greater than double the length 27 of the aforedescribed zone 26 must likewise be satisfied here.

The design of the wear protective unit according to the present invention thus permits a simple replacement of individual units without requiring removal of several units and an even greater packing effect is achieved in the embodiment shown in FIGS. 6 and 7.

Variations in the gap size due to sagging, as may be caused by the "shotpeening" effect, as well as by temperature variations and dimensional inaccuracies, are only minor in the wear protective assembly according to the present invention and they will have practically no influence upon the packing effect.

The favorable design features of the wear protective assembly for casting purposes, which is given by the substantially uniform wall thickness, permits economical production of the device and makes possible other forms thereof, for example, curved plates for lining of round chamber walls that are subjected to wear.

While specific embodiments of the invention have been shown and described in detail to illustrate the application of the inventive principles, it will be understood that the invention may be embodied otherwise without departing from such principles.

What is claimed is:

1. A wear protective liner assembly for lining the walls of a chamber subjected to wear, particularly a blast chamber, said assembly being formed of a plurality of liner units arranged adjacent each other in a two-dimensional array, each of said liner units comprising a plate member having four peripheral edges and a pair of generally planar congruent surfaces on opposite sides thereof bounded by said four edges, a first pair of raised lateral flanges extending respectively along two edges of said plate member on one side thereof a second pair of raised lateral flanges extending respectively along the other two edges of said plate member on the opposite side thereof, each of said flanges being arranged to overlap a flange of a next adjacent liner unit when said units are placed alongside each other in said two-dimensional array to form said liner assembly, and a reinforcing bead extending as a raised edge from said surface of said plate member along the peripheral edges thereof opposite to said flange members, each of said flanges being offset from a surface of said plate member by a distance which is at least equal to the sum of the thickness of said plate member and the height by which said bead is raised on said surface.

2. A wear protective liner assembly for lining the walls of a chamber subjected to wear, particularly a blast chamber, said assembly being formed of a plurality of liner units arranged adjacent each other in a two-dimensional array, each of said liner units comprising a plate member having four peripheral edges and a pair of generally planar congruent surfaces on opposite sides thereof bounded by said four edges, a first pair of raised lateral flanges extending respectively along two edges of said plate member on one side thereof, a second pair of raised lateral flanges extending respectively along the other two edges of said plate member on the opposite side thereof, each of said flanges being arranged to overlap a flange of a next adjacent liner unit when said units are placed alongside each other in said two-dimensional array to form said liner assembly, and a reinforcing bead extending as a raised edge from said surfaces of said plate member along the peripheral edges thereof opposite to said flange members, each of said flanges being formed to project laterally beyond said peripheral edges of said plate member, said flanges projecting beyond said peripheral edges by a distance which is at least equal to the width of said reinforcing beads.

3. An assembly according to claim 1 wherein each of said pair of flanges is formed as a unitary flange member extending continuously along two adjacent edges of said plate member.

4. An assembly according to claim 1 wherein each of said flanges comprises a pair of flange surfaces on opposite sides thereof which extend generally parallel to said surfaces of said plate member with one of said flange surfaces of each of said flanges being disposed to lie in the same plane as one of said surfaces of said plate member.

5. An assembly according to claim 1 wherein each of said flanges has one end which terminates a distance short of one of the peripheral edges of said plate member, with each of said flanges projecting laterally beyond the peripheral edges of said plate member by a distance which is at least equal to or greater than twice the distance by which a flange end falls short of a plate member edge.

6. A wear protective liner assembly for lining the walls of a chamber subjected to wear, particularly a blast chamber, said assembly being formed of a plurality of liner units arranged adjacent each other in a two-dimensional array, each of said liner units comprising a plate member having four peripheral edges and a pair of generally planar congruent surfaces on opposite sides thereof bounded by said four edges, a first pair of raised lateral flanges extending respectively along two edges of said plate member on one side thereof, a second pair of raised lateral flanges extending respectively along the other two edges of said plate member on the opposite side thereof, each of said flanges being arranged to overlap a flange of a next adjacent liner unit when said units are placed alongside each other in said two-dimensional array to form said liner assembly, each of said flanges having one end which terminates a distance short of one of the peripheral edges of said plate member, with each of said flanges projecting laterally beyond the peripheral edges of said plate member by a distance which is at least equal to or greater than twice the distance by which a flange end falls short of a plate member edge, each of said flanges forming a fillet extending generally parallel to one of the edges of said plate member, said liner unit being further provided with a projection member having a generally rectangular cross section provided in said fillets of said flanges to extend along said flanges with one side of said projection extending parallel to one side of said fillet and with the other side of said projection extending parallel to the other side of said fillet.

7. An assembly according to claim 6 wherein one side of said projection is of a dimension at least equal to the length of a side of said fillet extending generally perpendicularly to said plate member surfaces with the other side of said projection being of a length at least half the size, but smaller than the difference between the distance by which a flange member projects laterally beyond an edge of said plate member and the distance by which the end of the flange member falls short of an edge of said plate member.

8. A wear protective assembly according to claim 6 wherein one side of said projection is more than one-half the size of the width of a side of said fillet extending perpendicularly to the sides of said plate member with the other side of said projection being at most one-half the size of the difference between the distance by which a flange projects laterally beyond an edge of said plate member and the distance by which the end of a flange falls short of an edge of said plate member.

9. A wear protective liner unit for use in lining the walls of a chamber subjected to wear, particularly a blast chamber, said liner unit comprising a plate member having four peripheral edges and a pair of generally planar congruent surfaces on opposite sides thereof bounded by said four edges, and flange means arranged in pairs at said four peripheral edges, said flange means including flanges adapted to form with the flanges of an adjacent liner unit an overlapping joint when said units are placed alongside each other, the flanges of one pair of said flange means being offset in the direction of one of said surfaces of said plate member a distance which is equal to at least the thickness of said plate, each of said four peripheral edges having at one end thereof portions which are not provided with a portion of said flanges of said flange means.

10. A liner unit according to claim 9 wherein a bead is arranged along said peripheral edges on the surface of said plate member opposite said flanges.

11. A liner unit according to claim 10 wherein the width of said flanges protruding beyond the peripheral edges of said plate member is equal to at least the width of said bead.

12. A liner unit according to claim 10 wherein the distance by which said pair of flanges is offset from said one surface of said plate member is at least equal to the sum of the thickness of said plate member and the height of said bead.

13. A liner unit according to claim 12 wherein the width of said flange members protruding beyond the peripheral edges of said plate member is at least equal to twice the length of the portion of said peripheral edges not provided with an offset flange.

14. A liner unit according to claim 13 wherein each of said flanges forms a fillet extending generally parallel to one of the edges of said plate member, said liner unit being further provided with a projection member having a generally rectangular cross section provided in said fillets of said flanges.

15. A liner unit according to claim 14 wherein said projection member includes one side extending parallel to said plate surfaces of said plate member, said one side being more than half as large as the difference between the width of the flanges protruding beyond the peripheral edges of said plate member and the length of that portion of the peripheral edges of said plate member which are not provided with an offset flange.

16. A liner unit according to claim 14 wherein said projection member includes a side extending perpendicularly to the surfaces of said plate member said perpendicular side being more than half as large as the width of portions of said flanges which extend vertically to said plate member.

* * * * *